United States Patent [19]

Kringe et al.

[11] Patent Number: 5,048,984

[45] Date of Patent: Sep. 17, 1991

[54] MATRIX PRINTER

[75] Inventors: Horst Kringe, Netphen; Reinhold Winter, Wilnsdorf; Heinz M. Grevecoeur, Kreuztal-Ferndorf; Hartmut Korn, Munich, all of Fed. Rep. of Germany

[73] Assignee: U.S. Philips Corporation, New York, N.Y.

[21] Appl. No.: 489,421

[22] Filed: Mar. 5, 1990

[30] Foreign Application Priority Data

Mar. 4, 1989 [DE] Fed. Rep. of Germany ..... 3907080

[51] Int. Cl.[5] ..... B41J 3/02

[52] U.S. Cl. ..... 400/124; 101/93.05; 364/519; 377/64

[58] Field of Search ..... 400/121, 124, 61, 70, 400/303; 101/93.05, 93.04; 364/519; 377/64

[56] References Cited

U.S. PATENT DOCUMENTS

| | | | |
|---|---|---|---|
| 4,248,147 | 2/1981 | Zenner | 400/124 VI |
| 4,372,696 | 2/1983 | Pou | 400/124 |
| 4,421,431 | 12/1983 | Dorrfub et al. | 400/124 |
| 4,567,570 | 1/1986 | Peer | 400/121 |
| 4,602,880 | 7/1986 | Oba | 400/121 |
| 4,674,894 | 6/1987 | Tanaka et al. | 400/121 |
| 4,676,677 | 6/1987 | Sikiawm | 101/93.05 |
| 4,802,781 | 2/1989 | Sheerer | 400/124 |
| 4,856,920 | 8/1989 | Sanders, Jr. | 400/124 VI |
| 4,933,867 | 6/1990 | Ishigaki | 364/519 |
| 4,953,995 | 9/1990 | Sims et al. | 400/121 |

FOREIGN PATENT DOCUMENTS

| | | | |
|---|---|---|---|
| 0252066 | 6/1987 | European Pat. Off. . | |
| 2751326 | 5/1985 | Fed. Rep. of Germany . | |
| 3526369 | 7/1989 | Fed. Rep. of Germany . | |
| 0059860 | 4/1983 | Japan | 400/124 VI |

*Primary Examiner*—Eugene H. Eickholt
*Attorney, Agent, or Firm*—William Squire

[57] ABSTRACT

In matrix printers, the printing elements in the printing head are frequently arranged so that they do not correspond to the printing raster of the characters to be printed so that the informations delivered for each time a printing column at the same time must be delayed a time. For this purpose, a delay device is assigned to each printing element of a matrix printer, the delay times for each device representing paths mutually depending upon the orientation and spacing of the printing elements in the printing head and being determined by the time interval between a common writing pulse and individual element read-out pulses, which are produced by a shift register, in which the writing pulse is shifted at a relatively high rate depending upon the head position, the read-out pulses for the elements being produced by tappings on the shift register. By, by variation of the time intervals between the writing pulses, the density of the printing raster can readily be changed over from one character or one printing column to the other. By changing the tappings on the shift register, and thus the delays to the print elements, the inclination of the printing raster can be adjusted, for example, for printing in italics. More particularly for printing in opposite directions of movement of the printing head, the delay devices are preceded and followed by a switch matrix, which reverses the assignment of the delay information of the respective printing devices to the delay elements.

7 Claims, 4 Drawing Sheets

MATRIX PRINTER

Figure 1:
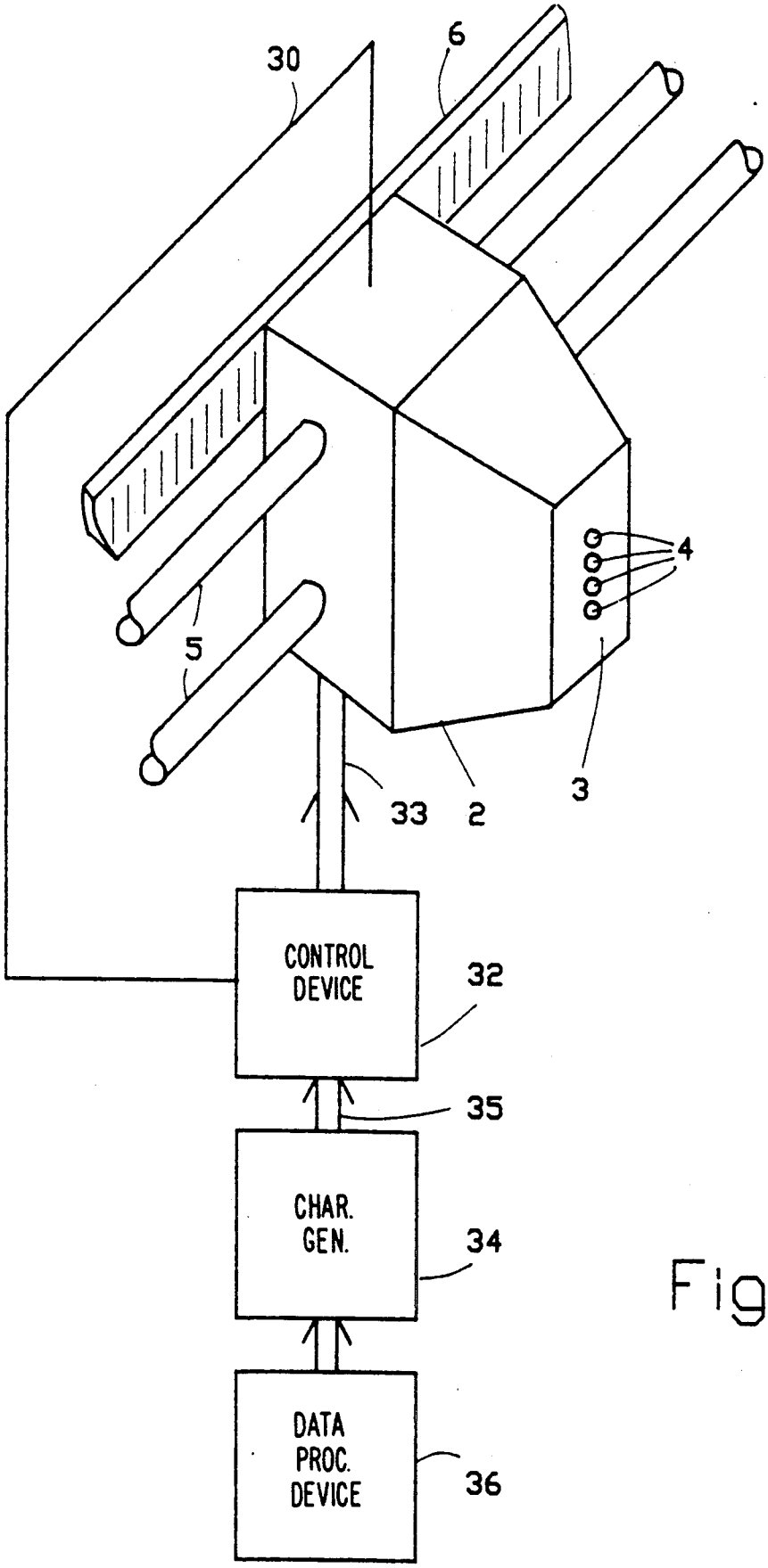

The invention relates to a matrix printer comprising a printing head moved along the printing line having several printing elements, which are arranged in the printing head so as to be at least in part relatively offset in the direction of movement and which print in the direction of movement in order of succession printing points in at least one given printing raster on a record carrier, and further a circuit arrangement for producing printing signals for the printing elements, the printing signals being derived from driving signals from at least one character generator.

Such a matrix printer is essentially known from DE-PS 26 32 293 which corresponds to U.S. Pat. No. 4,010,835. In this case, a printing head is used, in which the printing elements are arranged in two parallel rows, the rows being inclined with respect to the line perpendicular to the direction of movement. However, this inclination is small so that adjacent printing elements do not all coincide with the printing raster, but, when a printing element is located over a column of the printer raster, the adjacent printing element is located or the three printing elements adjacent to each other in one direction are located between this column and the next column of the printing raster. The printing operation is therefore effected at a printing rate which is two or four times higher than corresponds to the printing raster. However, a smallest possible integral ratio between the printing raster and the printing rate (emitter resolution) is aimed at. Due to the fact that, for example, the printing elements print a perpendicular line not at the same time, but by driving successively the needles at several printing rates, which also applies to most of the line elements present in printed characters, a smaller noise production and a smaller mechanical and electrical shock load are obtained, which is not indicated, however, in this Patent Specification. In fact, this reduction of the noise production and of the shock load is even smaller when the ratio between the printing raster and the printing rate is larger or is not integral Further, nothing is indicated in the aforementioned Patent Specification about the drive of the printing needles, but there must be started from a character generator which has a higher resolution according as the printing rate is higher and which occupies a considerable storage space, more particularly when different character types should be stored therein. Further, only a single printing raster is provided.

A matrix printer for printing in two different printing rasters, i.e. in a coarse and in a finer printing raster, is known, for example, from EP A 252 066. In this case, a printing head is used, in which the printing elements are arranged in two parallel rows perpendicular to the direction of movement. The two rows can further be relatively offset in the direction of these rows. For the higher resolution, the rows are displaced so that the printing elements of one row print between the areas on the record carrier, which are printed by the elements of the other row. Further, a higher printing rate is used so that oblique lines are closed to a great extent in order to obtain an optimal character image, more particularly for oblique lines. Two different character generators then have to be used.

The invention has for its object to provide a printer of the type mentioned in the opening paragraph, in which, whilst maintaining the reduction of the noise production and of the shock load, printing in different printing rasters, for example with a different printing column density or inclined printing rasters (printing in italics), is possible with the same character generator. Therefore, the logic printing raster, in which the characters in the character generator are stored, will be adapted to a geometric arrangement of the printing elements in the printing head.

This object is achieved in that for each printing element one delay device is provided, which delays the driving signals delivered at the same time by the character generator for a printing raster column by a delay time depending upon the path of the printing head or upon the speed of the printing head in accordance with the relative offset of the printing elements with respect to a column of the printing raster, this delay time being determined by the distance between a writing pulse occurring with the data originating from the character generator and a reading pulse individual for each delay device, which pulse is produced by tappings on a shift register, in which the writing pulse is shifted on by means of a pulse derived from the printing head position and having a pulse period which is considerably shorter than the period of the printing raster.

Due to the solution according to the invention, each individual printing element is therefore driven individually. This affords a number of surprising advantages. More particularly, a dynamic change of the density of printing columns during the printing of a line is possible without an empty space being required between areas having different printing column densities. An increase of the printing column density is obtained solely in that the character generator is read out at a correspondingly higher rate. In case a further storage is arranged between the character generator and the printing elements, which takes up the informations read out from the character generator for a line and stores them temporarily in the pixel plane, it is not necessary that it is known beforehand for this pixel storage, in which printing raster the pixels should be printed, for the printing raster is determined only by the density of the read-out pulses of the pixel storage. With a corresponding choice of the geometry of the head and of the arrangement of the printing elements therein, respectively, a reduction of the noise production and of the shock load can be attained also with different printing rasters. In principle, the individual delay of the driving signal for the printing elements permits of taking into account more particularly different printing head speeds (for example also during the acceleration and the braking of the printing head) by individual compensation of the printing delay of the printing elements (more particularly of the needle flying time in the case of a needle matrix printer).

Many matrix printers print, more particularly for increasing the effective printing speed, also during the reverse movement of the printing head. In order to make this possible in the simplest manner in the case of a relative offset of the printing elements in the direction of movement, i.e. with different printing head geometries, an embodiment of the invention is characterized in that the data inputs are preceded and the data outputs are followed each time by a change-over device, which, at least when the printing direction is changed over, changes over the assignment of the delay devices to the printing elements. For example in the case of obliquely arranged rows of printing elements, in fact that printing element which is the first to print in one direction of the movement of the printing head, for example for a vertical line is the last to print in the other direction of movement. By interchanging the delay devices and hence the delay times depending upon the path of the printing head or upon the speed of the printing head by the switches, this is immediately taken into account.

The DE PS 2632293 mentioned above further discloses a matrix printer comprising a printing head having two straight parallel rows of printing elements and being rotatable between two final positions in such a manner that in one final position the printing elements of both rows are located pairwise on the same horizontal line and in the other final position the printing elements of one row are located on horizontal lines which are located halfway between the horizontal lines of the other printing elements. The rows of the printing elements are tilted with respect to the perpendicular line in both final positions through the same angle so that that printing element of a row which is the first to print in one position of the printing head, for example for a perpendicular line, is the last of this row to print in the other final position of the printing head. In order to attain also in this case a simplest possible adaptation of the data delivered by the character generator to the position of the printing head, according to a further embodiment of the invention, it is efficacious that, when changing over the printing head from one final position to the other, the switches preceding and following the delay elements are also changed over. Also in this case, the effect of the matrix printer according to the invention is utilized such that the information of the printing raster is adapted to the arrangement of the printing elements in the printing head, for the rotation of the printing head from one position to the other is solely the adjustment of a different arrangement of the printing elements in the printing head.

This adaptation is essentially obtained by means of a shift register used in accordance with the invention, i.e. by the arrangement of the tappings thereon and the delay time between these tappings, which in fact represents a delay path. An effective construction of the shift register is therefore characterized according to a further embodiment of the invention in that the shift register comprises a number of groups each with second numbers of stages, of which each group delivers a read-out pulse for another delay device, which is moreover supplied to a next group, the second numbers of stages, after which a read-out pulse is delivered, being determined by the horizontal geometric arrangement of the printing elements in the printing head. Due to the corresponding numbers of stages between the tappings, an adaptation to substantially any geometric arrangement of the printing elements in the printing head is possible.

A particularly simple arrangement for printing obliquely arranged characters (printing in italics), is characterized according to a further embodiment of the invention in that a second number of stages of each group, after which a read-out pulse is delivered, are varied in order to influence the angular position of the printed characters. This can be attained in a particularly simple manner in that each of the last stages of each group of stages is followed by a selection switch and all selection switches are controlled in common.

By means of the matrix printer according to the invention, it is therefore possible in a very simple manner to print the character shape stored in the same character generator in different ways, for example in a narrowed or expanded printing raster or in a obliquely arranged printing raster.

Figure 2:
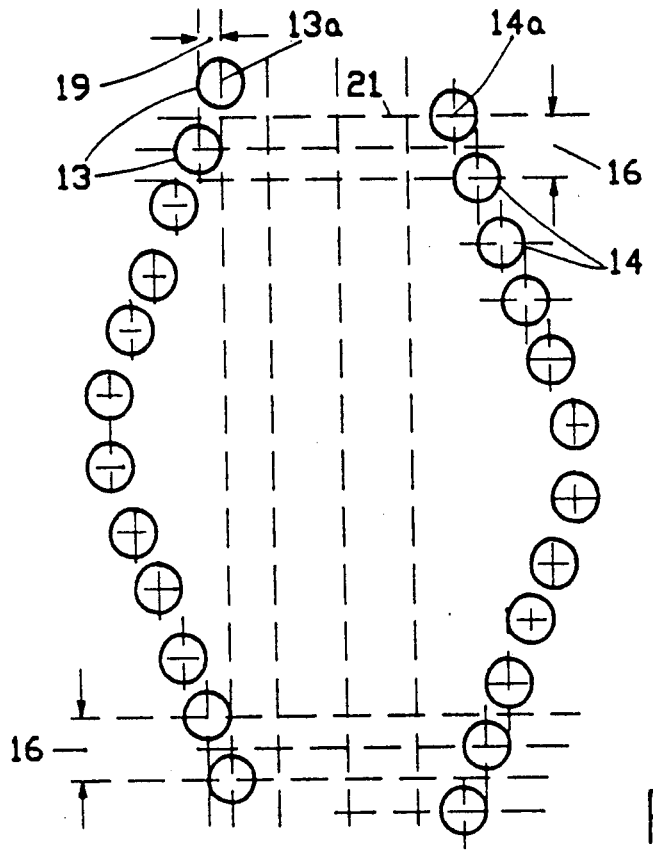
Figure 3A:
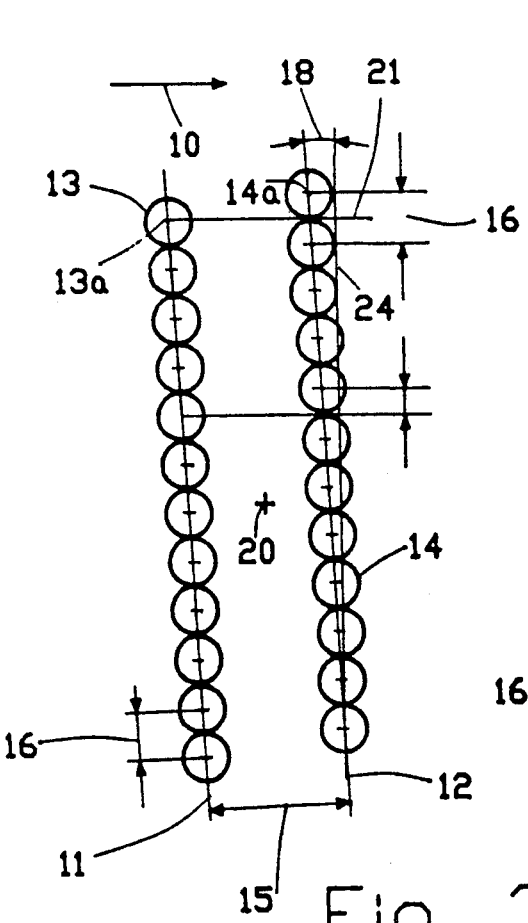
Figure 3B:
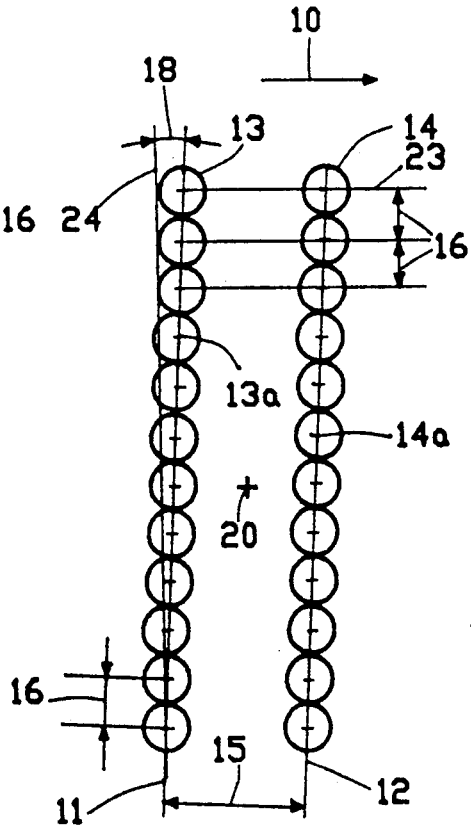
Figure 4:
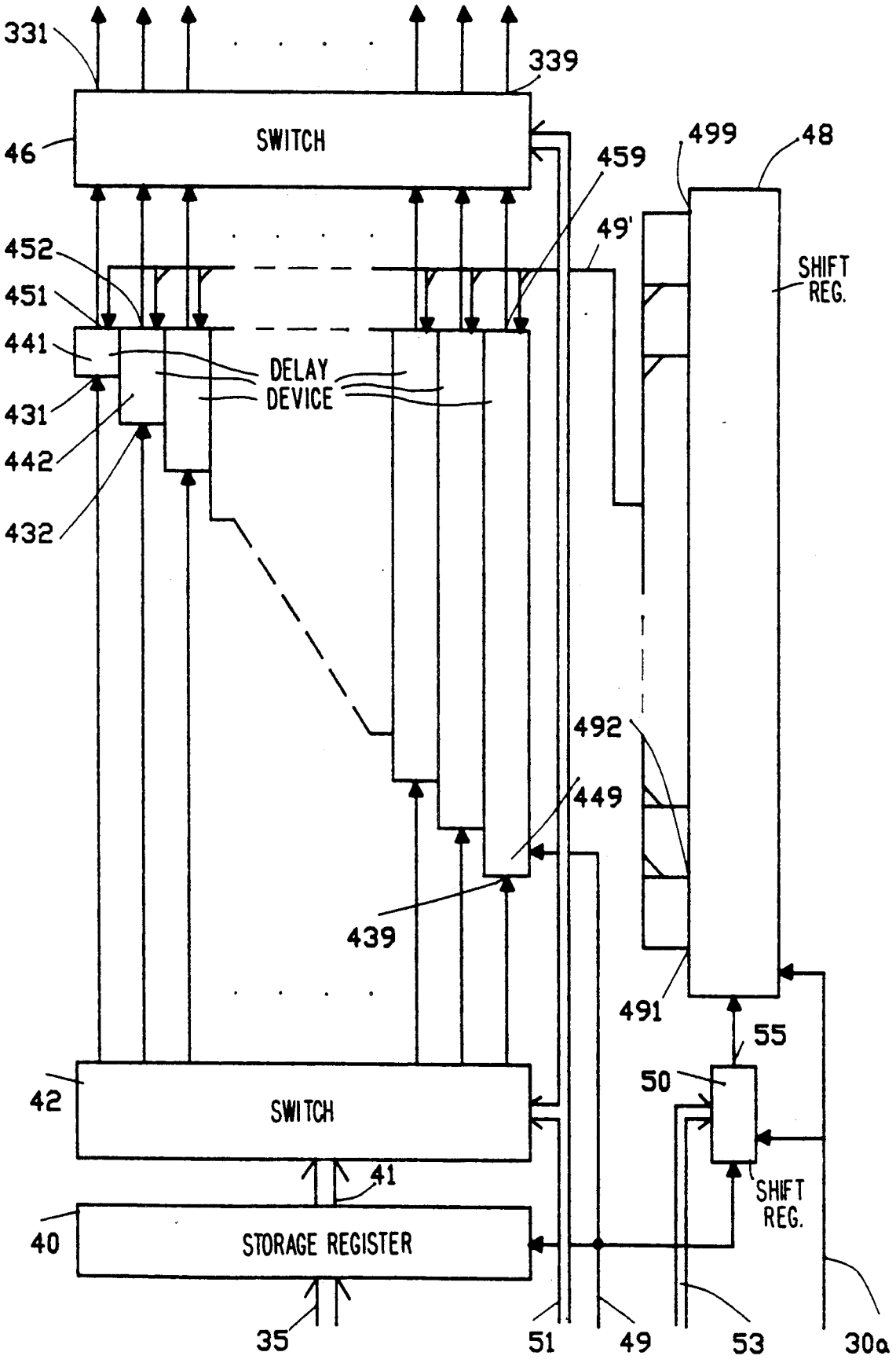
Figure 5:
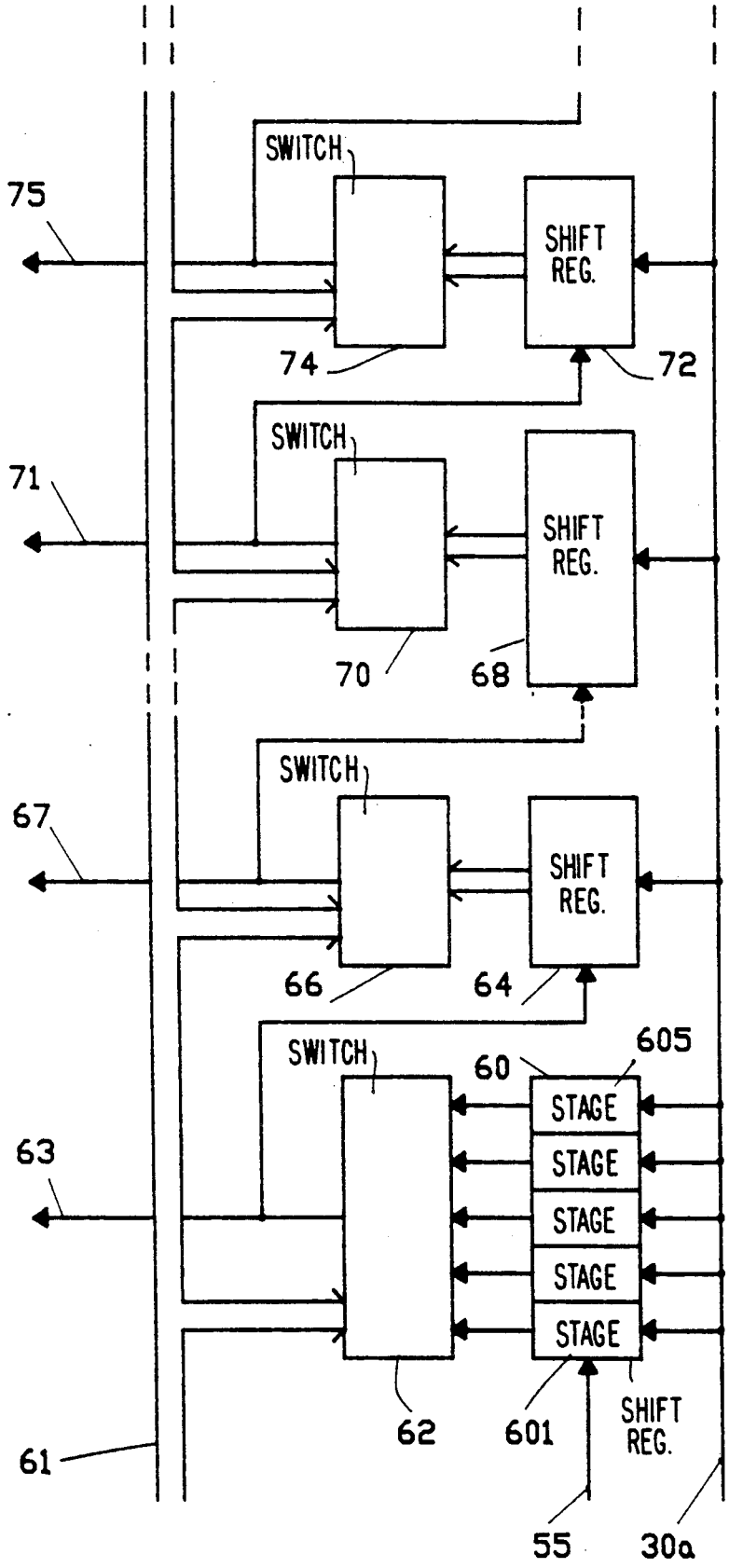

Embodiments of the invention will now be described more fully with reference to the accompanying drawing, in which:

FIG. 1 shows diagrammatically a movable printing head with a drive shown in a block circuit diagram, FIG. 2 shows an arrangement of the printing elements in a printing head, FIGS. 3*a* and 3*b* show different arrangements of the printing elements in a rotatable printing head different final positions, FIG. 4 shows a block circuit diagram of a device for driving the printing elements and, FIG. 5 shows an arrangement of shift registers for use in the circuit shown in FIG. 4.

FIG. 1 shows diagrammatically a rotatable printing head 2, in whose front head portion 3 facing a record carrier (not shown) are journalled a number of printing needles 4. These printing needles are driven by magnets in the printing head 2, which are not shown and are energized through signals, which are supplied through the multiple connection 33. The printing head 2 is slidably moved on the rods 5 and further comprises a device for scanning a stationary ruler 6, for example in a photoelectrical manner, in order to deliver through the lead 30 pulses, which indicate the position of the printing head 2 with respect to the ruler 6. The driving device for moving the printing head 2 is not shown for the sake of clarity.

The printing signals for the aforementioned magnets in the printing head 2 supplied through the connection 33 are produced by a control device 32, which receives driving signals from a character generator 34 which receives each time in parallel a column of the character to be printed in the form of a matrix. The character generator 34 is driven by a data processing device 36, which supplies the characters to be printed.

The printing signals produced by the control device 32 are synchronized by the position pulses on the lead 30 supplied to the control device 32 so that the character printed by the printing needles 4 on the record carrier corresponds to the desired character shape contained in the character generator 34.

FIG. 2 shows a plan view of the head surface 3 with an arrangement of printing needles, which are arranged in the form of a stretched rhomb. On the lefthand side, twelve printing elements in the form of printing needles 13 are arranged, of which the uppermost and lowermost needles are located vertically one over the other. The next uppermost and lowermost needles are also vertically over one another spaced horizontally offset from the vertical alignment of the uppermost and lowermost needles and so on. Just like the uppermost and lowermost needles the two central needles are vertically spaced one over the other. The vertical distances 16 between adjacent vertically spaced needles 13 and between vertically spaced needles 14 are equal. The horizontal offset distance 19 between two adjacent needles is also equal, but considerably smaller than the distance 16. The horizontal line 21 through the centre 14*a* of the uppermost needle 14 extends between the two uppermost needles 13. This correspondingly applies to all other centres of the needles and conversely also to the centres 13*a* of the needles 13.

When the head is moved, for example, to the right, for printing a vertical line first the two central needles 14 are driven, which are located in the extreme right-hand position, after which the needles 14 adjacent on both sides are driven, etc., until the two extreme needles 14 have been driven. By successively driving at least pairwise the needles 14, the noise production and also the mechanical as well as the electrical shock load are reduced. This applies especially when the printing raster is constructed so that each time always only one column of the printing raster corresponds to a pair of needles 14 and the adjacent columns of the printing raster are located at least in part between the needles.

When the head then has moved further to the right, until the two extreme needles 13 correspond to the line to be printed, these needles are driven, whereupon the remaining needles 13 are driven in a corresponding order of succession. The points printed by the needles 13 are therefore located between the points printed by the needles 14 or overlap each other in part so that a very smooth vertical line can be printed. In a corresponding manner, for example also oblique line elements are printed.

FIG. 3*a* shows another arrangement of the printing elements in the printing head. In this case, the printing elements or the printing needles 13 and 14, respectively, are arranged in two straight parallel rows 11 and 12, respectively, which are inclined with respect to the perpendicular line 24 through an angle 18. Also in this case, a horizontal line 21 passing through the centre 13*a* of the uppermost needle 13 extends exactly between the two uppermost needles 14. The vertical distance between the needles is again denoted by reference numeral 16. When the head moves to the right in the direction of the arrow 10, for printing a vertical line all needles 14 are successively driven and after a pause depending upon the distance 15 between the two rows all needles 13 are successively driven. Also in this case, a reduction of the noise production and of the shock load is thus attained when especially no needles or needles far remote from each other correspond to the printing raster. Due to the vertical relative offset of the needles 13 with respect to the needles 14, a vertical line is again produced from points overlapping each other to a great extent so that it strongly has the outer appearance of a smooth line. This also applies to character elements with other directions.

In FIG. 3*b*, the printing head with the needles 13 and 14 is rotated as a whole about an axis 20 so that the rows 11 and 12 are tilted with respect to the perpendicular line 24 through an angle 18, but now to the other side. In this case, the uppermost needles 13 and 14 are now located on the same horizontal line 23, and the same also applies to all the remaining needles of the two rows. In this position of the printing head, the printing speed is higher when the maximum frequency of the needle actuation is given. The printed characters have horizontally and vertically a coarse structure with respect to the other position of the printing head. For the reduction of the noise production and of the shock load, the same applies to the head position shown in FIG. 3*b* as to the head position in FIG. 3*a*.

The driving signals for a vertical line or more generally for all printing points located in a column of the printing raster are delivered in parallel by the character generator, but have to drive the associated printing needle at different instants, i.e. when this needle has just reached the relevant printing column. The driving signals therefore must be delayed differently in accordance with the geometric arrangement of the printing elements in the printing head to obtain the printing signals. This takes place by the device which is shown in a block circuit diagram in FIG. 4 and essentially corresponds to the control device 32 in FIG. 1. In this case, the data for each time one printing column supplied in parallel through the connection 35 from the character generator are supplied to a storage register 40 and are written into it by means of a pulse on the lead 49, which is produced after the character generator has been read out. This storage register 40 is shown only for the sake of completeness and is not absolutely necessary for the principle of the operation.

The data contained in the storage register 40 are supplied through the connection 41 to a switch 42, which supplies these parallel data in a selectable and switchable device to the data inputs 43, 432, ... 439 of a number of delay devices 441, 442, . . . 449. The actual number and the distribution depend upon the number and the geometric arrangement of the printing elements in the printing head. If the delay time of the delay elements 441 etc. is indicated symbolically by the length of the corresponding boxes shown in FIG. 4, in a printing head shown in FIG. 2 the information for the two central needles 14 are supplied to the delay device 441, which for this case could take up and delay each time two bits, while the information for the next two adjacent printing needles 14 is supplied to longer delay device 442, etc.

In a corresponding manner, in the arrangement of the printing elements in the printing head and the adjustment thereof according to FIG. 3*a*, the information for the lowermost needle 14 in the row 12 is supplied to the delay device 441, the information for the next lowermost printing needle 14 is supplied to the next longer delay device 442, etc. For each printing needle 14 and 13, a delay element 441, 442, . . . is therefore provided, whose delay is dependent upon the path of the printing head or upon the speed of the printing head depending upon the arrangement of the printing elements in the head. The data outputs 451, 452, . . . 459 of the delay devices are followed by a second switch 46, which carries out an assignment of the switch 42 at the mirror image place so that the information assigned to the lowermost line of the printing raster in fact is supplied to the output 331 of the switch 46 for the magnet of, for example, the lowermost needle 14 in FIG. 3*a* and correspondingly the informations of the other printing raster lines are supplied to the respective corresponding magnets of the other printing needles 14 and 13.

As already stated with reference to the explanation of FIGS. 2 and 3*a*, when the printing direction, i.e. the direction of movement of the printing head, is reversed, this assignment must be reversed, just like in the case of change-over of the printing head from the position of FIG. 3*a* to the position of FIG. 3*b*. This takes place in the switches 42 and 46, respectively, by a corresponding drive through the multiple lead 51, which therefore indicates at least the printing direction and the position of the printing head.

The delay of the individual delay elements 441, 442, . . . 449 is now determined by time the interval between a writing pulse supplied through the lead 49 and individual read-out pulses produced by a shift register 48 at outputs 491, 492, . . . 499 and supplied to the delay devices through the multiple connection 49'. Therefore, by means of the writing pulse on the lead 49, the driving signals supplied by the character generator for a printing column are written into the storage register 40 and at the same time the data contained beforehand in the storage register 40 are written into the delay devices 441, 442, . . . . Further, this writing pulse is also written into the first stage of the shift register 48 if in this case the shift register 50 is left out of consideration. The delay devices 441, 442, . . . are constructed, for example, as FIFO storages, which successively take up information by means of successive writing pulses and then again deliver this information in the same order of succession, depending upon read-out pulses. The delay device 449 therefore must be able to take up a number of data corresponding to the maximum number of printing raster columns between the printing elements remotest from each other with the narrowest printing raster, while the delay device 441 must practically take up each time only at least one information.

The representation of the delay devices 441, 442, . . . and the preceding and following switches 42 and 46 is only diagrammatic and their function may also be realized technically in a different manner.

In the shift register 48, the writing pulse is shifted on by a high-rate pulse supplied through the lead 30*a* and derived from the position pulses on the lead 30 from the scanning of the ruler 6 by the printing head 2, efficaciously by frequency multiplication. The resolution in time and hence in path of this high-rate pulse more particularly depends upon the ratio of the horizontal distance between the needles and the different printing rasters and printing densities, respectively, in which there is to be printed according to choice. The repetition rate of the high-rate pulses depends upon the horizontal speed of the printing head. At least one high-rate pulse must occur when the printing head has moved through the horizontal offset between two adjacent printing elements, but a double or a multiple thereof is efficacious to be able to print a largest possible number of different printing rasters with a reduced production of noise and of shock load. The number of shift register stages between each time two successive tappings 491 and 492 etc. depends upon this resolution of the high-rate pulse, which has once been chosen and thus been given, the horizontal offset between adjacent needles being reduced, as already stated above.

With mechanical printing elements, such as printing needles, the driving signal must be produced before the relevant needle has reached the printing area in order to take into account the needle flying time. At a constant speed of movement of the head, this delay in time or in fact in path is constant, but must be correspondingly taken into account upon reversal of the printing direction. The character information is therefore supplied already with the delay value for the maximum speed of the printing head by the character generator. However, in case the printing head does not move at a constant speed especially during starting and during running out, the delay with the needle drive must be correspondingly compensated for. With slow speed variations, this can be attained by means of an additional shift register 50, into which the writing pulse on the lead 49 is written and whose length is adjusted through the multiple lead 53, depending upon the speed of the printing head, for example in that the writing or reading-out is correspondingly driven. At low speeds of the printing head, the length of the shift register 50 must be greater and hence the effective delay must be smaller because then the printing head requires more time to attain after the writing pulse the printing area on the record carrier, at which the information delivered by means of the writing pulse are to be printed. The corresponding correct delay time between the drive of the relatively horizontally offset printing elements depending upon the path of the printing head or upon the speed of the printing head is automatically attained by the shift register 48 in that the high-rate pulse on the lead 30*a* is not a pulse depending upon time, but a pulse depending upon the path. For this reason, an immediate change of the printing column density is also possible because the latter is produced only in that in a correspondingly more rapid succession printing data with associated writing pulses are supplied, while the delay of the writing pulse in the shift register 48 only depends upon the speed of the printing head. The position of the tappings 491, 492, . . . 499 on this shift register 48 only depends upon the geometric arrangement of the printing elements in the printing head because this position of the tappings determines a delay depending upon the path.

However, this only holds when there is to be printed in an obliquely arranged printing raster, that is to say that a line stored as vertical in the character generator is also printed vertically. A printing in an obliquely arranged printing raster, i.e. printing in italics, can be obtained on the contrary in that the position of the tappings 491, 492, . . . 499 of the shift register 48 is changed. This is particularly simple in an arrangement of the printing elements in the printing head according to FIG. 3*a*, for when the delay of the drive of the printing needles 14 and 13, respectively, increases more strongly from the lower to the upper needles than corresponds to the inclination 18, for example a vertical line inclined towards the righthand side is printed.

A possibility of changing the tappings of the shift register 48 is shown in FIG. 5. In this case, the shift register 48 shown in FIG. 4 consists of a number of groups 60, 64, 68, 72, which each time consist of a number of individual shift register stages; for the sake of clarity, only for the group 60 the individual stages 601 . . . 605 are shown separately. Also the remaining groups 64, 68, 72 shown consist of a series of such individual shift register stages. It should be noted that in fact more groups of shift register stages are present than is shown, as is indicated by the broken connection lines. The group 68 comprises a considerably larger number of stages because the latter must produce the delay through the distance 15 between the two rows of needles in FIG. 3*a*. It is clear that this number of stages must be constant independently of an inclination of the printing raster.

The outputs of the individual stages 601, . . . 605 of the group 60 as well as of the corresponding stages of the groups 64, 68, 72 are each time followed by a switch 62, 66, 70, 74, which selects one of these outputs and connects it to the output 63, 67, 71, 75. This selection is controlled by the information on the connection 61, which controls all switches 62, 66, 70, 74 in common. The outputs 63, 67, 71, 75 are each time connected to the inputs of the next stage 64, 68, 72 . . . . A writing pulse supplied through the output 75 is therefore delivered with different delays, depending upon the information on the connection 61, at the outputs 63, 67, 71, 75, which represent the read-out pulses for the delay devices 441, 442 . . . 449. The width of the printing rasters on the contrary is not influenced by the information on the connection 61.

By means of the measures described, it is therefore possible in a comparatively simple manner to change character shape contained in the character generator in different ways during printing.

What is claimed is:

1. A matrix printer for printing a raster comprising at least one column, said printer including a print head adapted to move along a print line in a first direction and means for generating a print head position signal manifesting the position of said print head, said head including a plurality of print elements arranged to be at least in part offset from one another in said first direction, said elements for printing in said first direction in order of successive printing points at least one given printing raster on a record carrier, said printer further comprising a circuit arrangement for producing printing signals for the printing elements, the printing signals for each element being derived from element driving signals produced simultaneously for printing a raster column from at least one character generator, the combination therewith comprising:

a delay device associated with each element arranged to selectively delay the driving signal corresponding to that element applied to a data input thereto relative to the data output thereof in a given sequence, the delay time for each element having a value determined in accordance with the path of the printing head and upon the speed of the printing head corresponding to the relative offset of each printing element with respect to the raster column then being printed;

means for generating a writing pulse for writing character data into said delay devices; and reading pulse generating means including shift register means responsive to said writing pulse and to a shift pulse applied thereto for generating a read pulse for reading character data from each said delay device, said delay time for each device being further determined by the time interval between said writing and reading pulses such that said elements print said given raster in accordance with the selective delay determined for each element.

2. A matrix printer as claimed in claim 1 wherein the data inputs to said delay devices are preceded and the data outputs are followed each time by switching means, which, at least when the first printing direction of the printing head is reversed to an opposing direction, reverse the order of the sequence of assignment of the delay devices to the printing elements.

3. A matrix printer as claimed in claim 2 wherein said head has two straight parallel rows of printing elements and is rotatable between two final positions in such a manner that in one final position the printing elements of both rows are located pairwise on the same horizontal line and in the other final position the printing elements of one row are located on horizontal lines which are located halfway between the horizontal lines of the other printing elements, the switching means being arranged so that when the printing head is moved from one final position to the other, the switching means are caused to reverse said order of the sequence.

4. A matrix printer as claimed in claim 1 wherein the printing elements have a given horizontal geometric arrangement and the shift register means comprises a first number of groups of shift registers each with a second number of stages, each group for generating a read-out pulse for a delay device, which read-out pulse is supplied to a next group, the second number of stages, after which a read-out pulse is delivered, corresponding to said given horizontal geometric arrangement of the printing elements in the printing head.

5. A matrix printer as claimed in claim 4 including means for varying the second number of stages of each group, after which a read-out pulse is delivered, in order to influence the angular position of the printed characters.

6. A matrix printer as claimed in claim 5 further including a selection switch following each of the last stages of each group and means for controlling all selection switches in common.

7. The printer of claim 1 including means for deriving said shift pulse said head position signal, said shift pulse having a pulse repetition rate higher than that of said write pulse and substantially higher than the raster print rate.

* * * * *